US007874866B2

(12) United States Patent
Patchett

(10) Patent No.: US 7,874,866 B2
(45) Date of Patent: Jan. 25, 2011

(54) LABELING ASSEMBLY

(75) Inventor: Leonard James Patchett, Leederville (AU)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 12/470,821

(22) Filed: May 22, 2009

(65) Prior Publication Data

US 2009/0298323 A1 Dec. 3, 2009

(30) Foreign Application Priority Data

May 28, 2008 (AU) ..... 2008902676

(51) Int. Cl.
*H01R 3/00* (2006.01)

(52) U.S. Cl. ..... 439/491; 108/10; 248/28.11

(58) Field of Classification Search ..... 439/491; 108/10; 248/28.11; 211/90.02
See application file for complete search history.

(56) References Cited

U.S. PATENT DOCUMENTS

| | | | | |
|---|---|---|---|---|
| 6,086,415 | A * | 7/2000 | Sanchez et al. | 439/540.1 |
| 6,347,715 | B1 * | 2/2002 | Drozdenko et al. | 211/26 |
| 7,200,931 | B2 * | 4/2007 | Clark et al. | 29/868 |
| 7,438,592 | B2 | 10/2008 | Skluzacek et al. | |
| 7,687,716 | B2 * | 3/2010 | Pepe et al. | 174/101 |
| 2002/0129959 | A1 | 9/2002 | Peterson | |

FOREIGN PATENT DOCUMENTS

| | | |
|---|---|---|
| DE | 88 02 659 | 5/1989 |
| FR | 2 685 824 | 7/1993 |

* cited by examiner

*Primary Examiner*—Ross N Gushi
(74) *Attorney, Agent, or Firm*—Merchant & Gould P.C.

(57) ABSTRACT

A patch cord panel and a labeling assembly for use in the identification of jacks of the patch cord panel including an information plate having a plurality of predetermined areas for bearing indicia for uniquely identifying respective ones of the jacks of the patch cord panel, and a fastener for coupling the information plate to the patch cord panel.

9 Claims, 6 Drawing Sheets

LABELING ASSEMBLY

This application is a claims benefit of Serial No. 2008902676, filed 28 May 2008 in Australia and which application is incorporated herein by reference. To the extent appropriate, a claim of priority is made to the above disclosed applications.

FIELD OF THE INVENTION

The invention generally relates to a labeling assembly for use in the identification of individual jacks of a patch cord panel. In particular, the present invention relates to a labeling assembly for use in identifying and sorting of a plurality of patch cords electrically connected to a patch cord panel.

BACKGROUND OF INVENTION

Patch cords have previously been used for the transmission of power and data in telecommunication networks. As usage of patch cords increases, so does the density and complexity of suitable interfaces, such as patch cord panels. When the density of jacks of a patch cord panel is high, it may become difficult to uniquely identify each jack for termination with a corresponding plug of a patch cord. This can cause difficulties with the installation and maintenance of telecommunication networks that includes one or more patch cord panels. Further, the above described problems may lead to erroneous connections which may lead to loss of data, for example.

It is generally desirable to overcome or ameliorate one or more of the above described problems, or to at least provide a useful alternative.

SUMMARY OF INVENTION

In accordance with one aspect of the invention, there is provided, a labeling assembly for use in the identification of jacks of a patch cord panel:

(a) including an information plate having a plurality of predetermined areas for bearing indicia for uniquely identifying respective ones of the jacks of the patch panel; and (b) a fastener for coupling the information plate to the patch cord panel.

Preferably, the location of each predetermined area of said predetermined areas corresponds to the location of a corresponding jack of said jacks.

Preferably, the fastener is adapted to couple the information plate to the patch panel in a position where the predetermined areas are adjacent corresponding jacks.

Preferably, the information plate includes a generally planar body section having the plurality of predetermined areas for bearing indicia for uniquely identifying respective ones of the jacks of the patch panel.

In accordance with another aspect of the invention, there is provided, a patch cord panel having the above-described labeling assembly coupled thereto.

BRIEF DESCRIPTION OF THE DRAWINGS

Preferred embodiments of the invention are hereafter described, by way of non-limiting example only, with reference to the accompanying drawings, in which.

DETAILED DESCRIPTION OF PREFERRED EMBODIMENTS OF THE INVENTION

Figure 1:
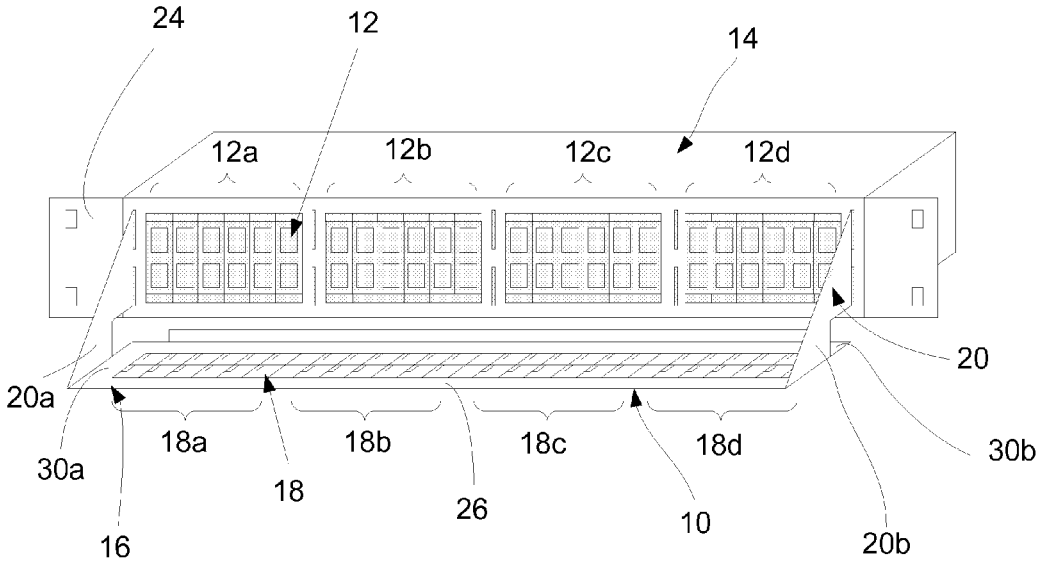
FIG. 1 is a front perspective view of a labeling assembly coupled to a patch cord panel.
Figure 2:
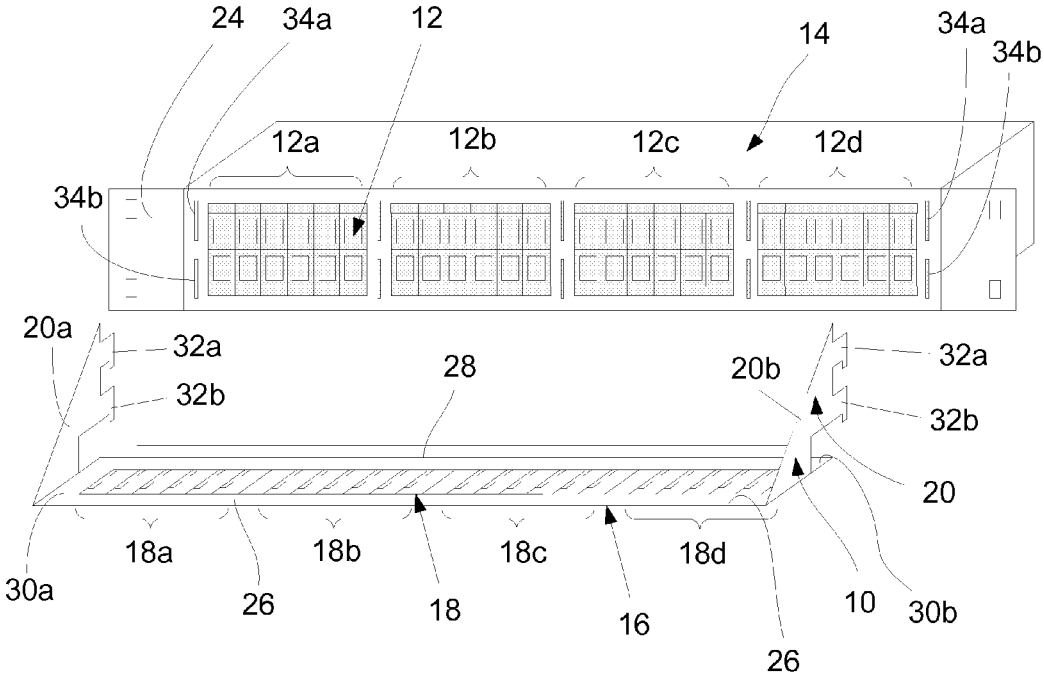
FIG. 2 is a front perspective view of the labeling assembly shown in FIG. 1 detached from the patch cord panel.

The labeling assembly 10 shown in FIGS. 1 and 2 is used to assist in the identification of jacks 12 of a patch cord panel 14. The assembly 10 includes an information plate 16 having a plurality of predetermined areas 18 for bearing indicia for uniquely identifying respective ones of the jacks 12 of the patch panel 14. The assembly also includes a fastener 20 for coupling the information plate 16 to the patch cord panel 14.

The patch cord panel 14 includes four groups 12*a*, 12*b*, 12*c*, 12*d* of twelve jacks 12 arranged side by side along a front face 24. The jacks 12 of each group 12*a*, 12*b*, 12*c*, 12*d* are arranged in two rows stacked on top of one another.

The information plate 16 includes a generally planar, rectangular main body section 26. The plate also includes four groups 18*a*, 18*b*, 18*c*, 18*d* of twelve predetermined areas 18 for bearing indicia for labeling the jacks 12 of the patch cord panel 14. The predetermined areas 18 of each group 18*a*, 18*b*, 18*c*, 18*d* are arranged in two rows stacked on top of one another. A long side 28 of the rectangular main body section 26 is shaped to abut the front face 24 of the patch cord panel 14 in such a way that the four groups 18*a*, 18*b*, 18*c*, 18*d* of predetermined areas 18 are located adjacent corresponding groups 12*a*, 12*b*, 12*c*, 12*d* of jacks 12.

The fastener 20 includes two brackets 20*a*, 20*b*, coupled to respective short ends 30*a*, 30*b* of the rectangular body section 26. The brackets 20*a*, 20*b* extend in a generally normal direction away from the planar body section 26 and each include a pair of lugs 32*a*, 32*b* for mating with receptacles 34*a*, 34*b* formed in the front face 24 of the patch cord panel 14. The fastener 20 couples the labeling assembly 10 to the patch cord panel 14 when the lugs 32*a*, 32*b* are seated in corresponding recesses 34*a*, 34*b*. When so arranged, the four groups 18*a*, 18*b*, 18*c*, 18*d* of predetermined areas 18 are located adjacent corresponding groups 12*a*, 12*b*, 12*c*, 12*d* of jacks 12.

The location of each predetermined area 18 of the labeling assembly 10 is arranged to correspond to the location of a corresponding jack 12 of the patch cord panel 14. As such, the labeling assembly 10 functions as a key for uniquely identifying each jack 18 of the patch cord panel 14. The plurality of predetermined areas 18 of the labeling assembly 10 may be an array of cells, each made of a material capable of bearing indicia from a felt tip pen, for example, or any other suitable writing instrument. The array of predetermined areas 18 may be either fixed to the assembly 10, or, alternatively, detachable for replacement. The plurality of predetermined areas 18 can thereby be used to record information about each jack 12 of the patch cord connector 14.

Besides the above-described plurality of predetermined areas 18 for labeling the jacks 12, the labeling assembly 10 also includes predetermined areas for identifying free jacks, and for labeling functions of patch cords and other identifying information, for example.

Figure 3:
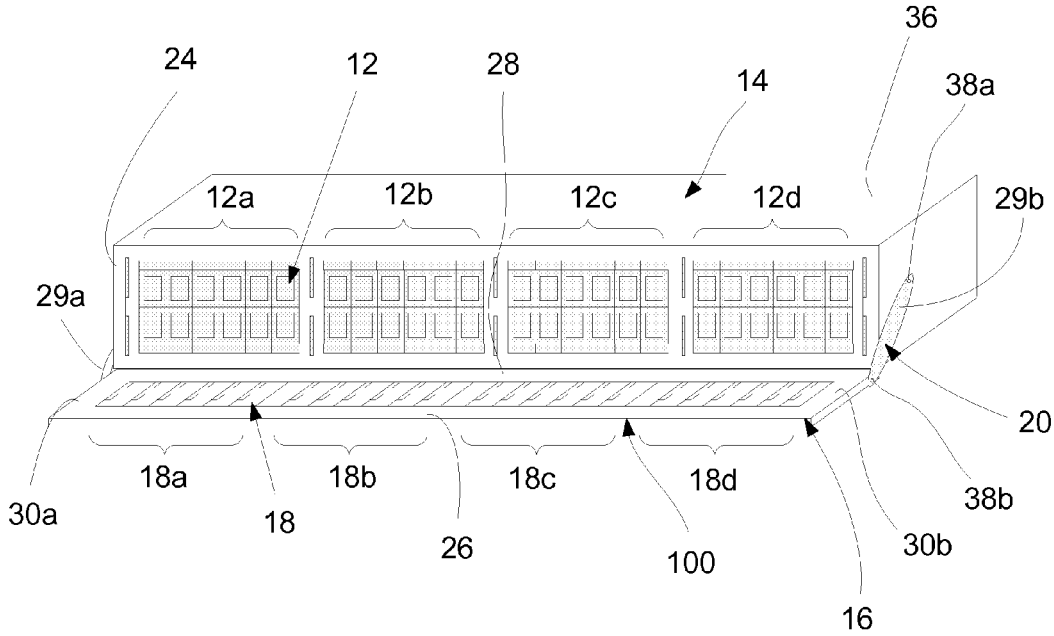
FIG. 3 is a front perspective view of another labeling assembly coupled to a patch cord panel.
Figure 4:
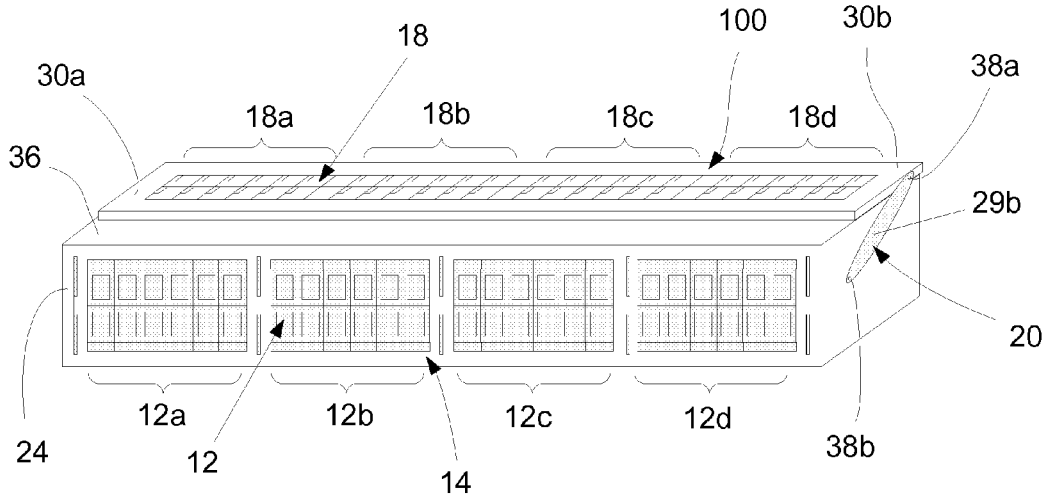
FIG. 4 is a front perspective view of the labeling assembly shown in FIG. 3 arranged in another condition of use.
Figure 5:
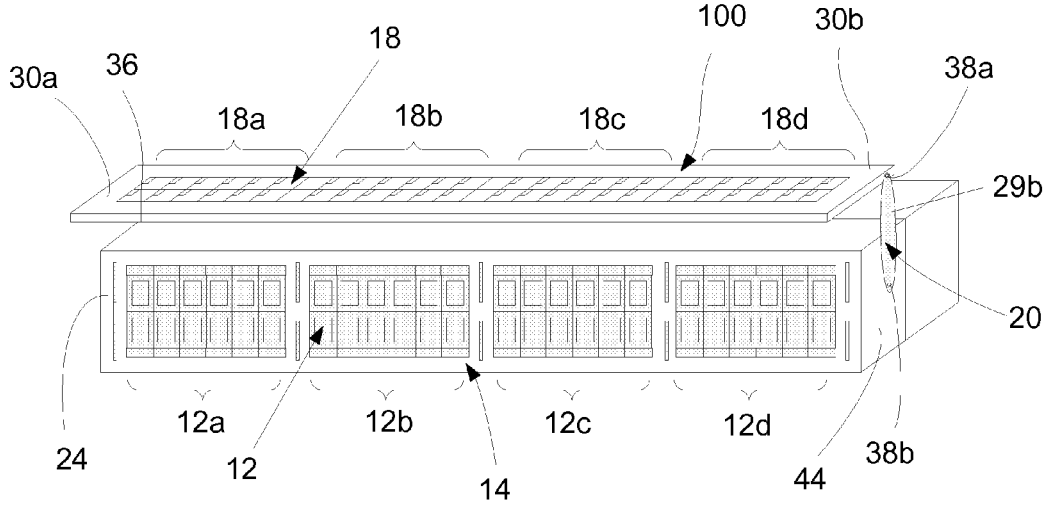
FIG. 5 is a front perspective view of the labeling assembly shown in FIG. 3 arranged in yet another condition of use.

The labeling assembly 100 shown in FIGS. 3 to 5 is used to assist in identifying jacks 12 of a patch cord panel 14. The assembly 100 includes an information plate 16 having a plurality of predetermined areas 18 for bearing indicia for uniquely identifying respective ones of the jacks 12 of the patch panel 14. The assembly 100 also includes a fastener 20 for coupling the information plate 16 to the patch cord panel 14. The assembly 100 operates in an analogous manner to that of the assembly 10 and like parts a marked with like numbers.

As before, the patch cord panel 14 includes four groups 12*a*, 12*b*, 12*c*, 12*d* of twelve jacks 12 arranged side by side along a front face 24. The jacks 12 of each group 12*a*, 12*b*, 12*c*, 12*d* are arranged in two rows stacked on top of one another.

The information plate 16 includes a generally planar, rectangular main body section 26. The plate 16 also includes four groups 18*a*, 18*b*, 18*c*, 18*d* of twelve predetermined areas 18 for bearing indicia for labeling the jacks 12 of the patch cord panel 14. The predetermined areas 18 of each group 18*a*, 18*b*, 18*c*, 18*d* are arranged in two rows stacked on top of one another. A long side 28 of the rectangular main body section 26 is shaped to abut the front face 24 of the patch cord panel 14 in such a way that the four groups 18*a*, 18*b*, 18*c*, 18*d* of predetermined areas 18 are located adjacent corresponding groups 12*a*, 12*b*, 12*c*, 12*d* of jacks 12.

The location of each predetermined area 18 of the labeling assembly 10 is arranged to correspond to the location of a corresponding jack 12 of the patch cord panel 14. As such, the labeling assembly 100 functions as a key for uniquely identifying each jack 18 of the patch cord panel 14. The plurality of predetermined areas 18 of the labeling assembly 10 may be an array of cells, each made of a material capable of bearing indicia from a felt tip pen, for example, or any other suitable writing instrument. In this embodiment, the array of predetermined areas 18 may be either fixed to the assembly 10, or, alternatively, detachable for replacement. The plurality of predetermined areas 18 can thereby be used to record information about each jack of the patch cord connector 14.

Besides the above-described plurality of predetermined areas 18 for labeling the jacks 12, the labeling assembly 10 also includes predetermined areas for identifying free jacks, and for labeling functions of patch cords and other identifying information.

As particularly shown in FIG. 3, the fastener 20 includes a pair of elongate arms 29*a* and 29*b*, moveably joined to the information plate 16 at opposite ends 30*a*, 30*b* thereof, for connecting the information plate 16 to the patch panel 14 and locating it relative thereto. The information plate 16 is movable from the position shown in FIG. 3, where the plate 16 is arranged at the foot of the front face 24 of the patch cord panel 14, to the position shown in FIG. 4, where the plate is seated on a top side 36 of the patch cord panel 14. In either of these two positions, the labeling assembly 10 functions as a key for uniquely identifying each jack 12 of the patch cord panel 14.

As particularly shown in FIG. 5, first and second ends of each arm 29*a*, 29*b* are respectively coupled to the plate 16 and the patch cord panel 14 by moveable joints 38*a*, 38*b*. The movable arms 29*a*, 29*b* permit movement of the plate 16 into a position convenient for viewing the information inscribed on the predetermined areas 18 for bearing indicia. The joints 38*a*, 38*b* of each arm 29*a*, 29*b* are preferably rim and socket friction fit joints wherein, for each joint 38*a*, 38*b*, a rim is fixed, by integral formation or an appropriate fastener, to the information plate 16 in a position convenient for locating to an arm 29*a* or 29*b* relative thereto. Furthermore, a socket is integrally formed in the end of each arm 29*a* or 29*b*, and each socket being adapted to receive a rim and thereby provide a point of frictional engagement between the arms 29*a* or 29*b* and the information plate 16.

The friction between rims and sockets of each joint 38*a*, 38*b* is generally sufficient such that the information plate 16 will remain in substantially a desired location unless intentionally urged into a different position.

As particularly shown in FIG. 5, the labeling assembly 100 preferably includes a sleeve 44, moveably interposed between the arms 29*a* and 29*b* and the patch panel 14. The sleeve 44 permits tight-fitted slidable mounting of the labeling assembly 100 to the patch panel 14, for the locating of the assembly 100 relative thereto. The sleeve 44 may be slid backward, with respect to the patch panel 14, in order to avoid the assembly 100 becoming an obstruction during coupling/decoupling of patch cord with/from the patch panel 14. Furthermore, the sleeve 44 restricts movement of the assembly 10 during use with a patch panel 14.

The sleeve 44 may be fastened to the patch panel 14 by any appropriate fastening means, in order prevent it moving relative thereto during operation. It will be appreciated that a skilled person would contemplate many other sorts of fastener as being compatible for use with the sleeve and patch panel.

The rotatable joints 38*a*, 38*b* between the arms 29*a* and 29*b* and sleeve 44 allow the information plate 16 to be relocated between desired positions both above and below the jacks 12. The rotational movement is again afforded by rim and socket friction-fit joints 38*a*, 38*b*, as described above, the socket being again formed into the end of the arm 29*a* or 29*b* and the rim being fixed to the sleeve 44.

For particular applications, it may be desirable to substitute the moveable joints 38*a*, 38*b* with a rigid connection, such as by welding or the use of adhesives.

Figure 6:
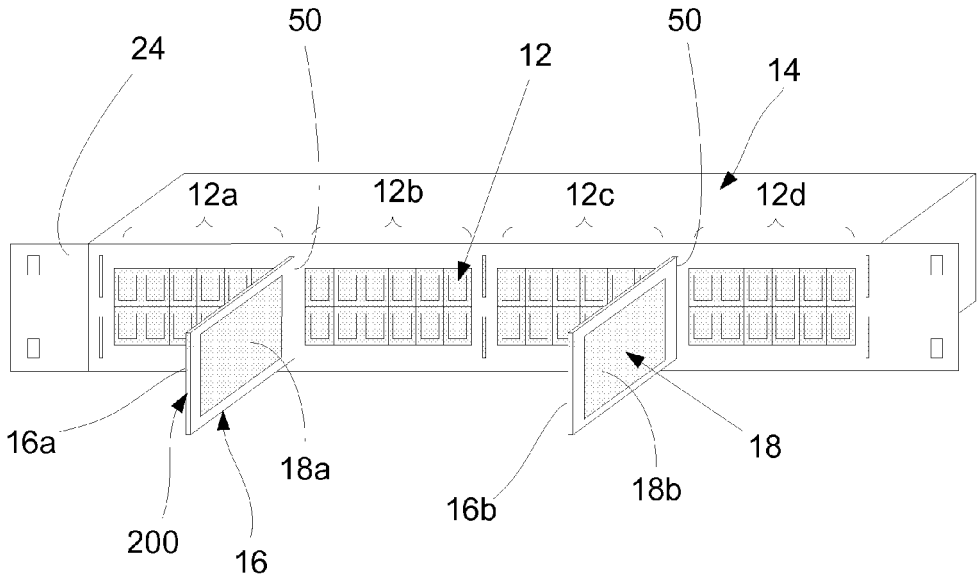
FIG. 6 is a front perspective view of yet another labeling assembly coupled to a patch cord panel.
Figure 7:
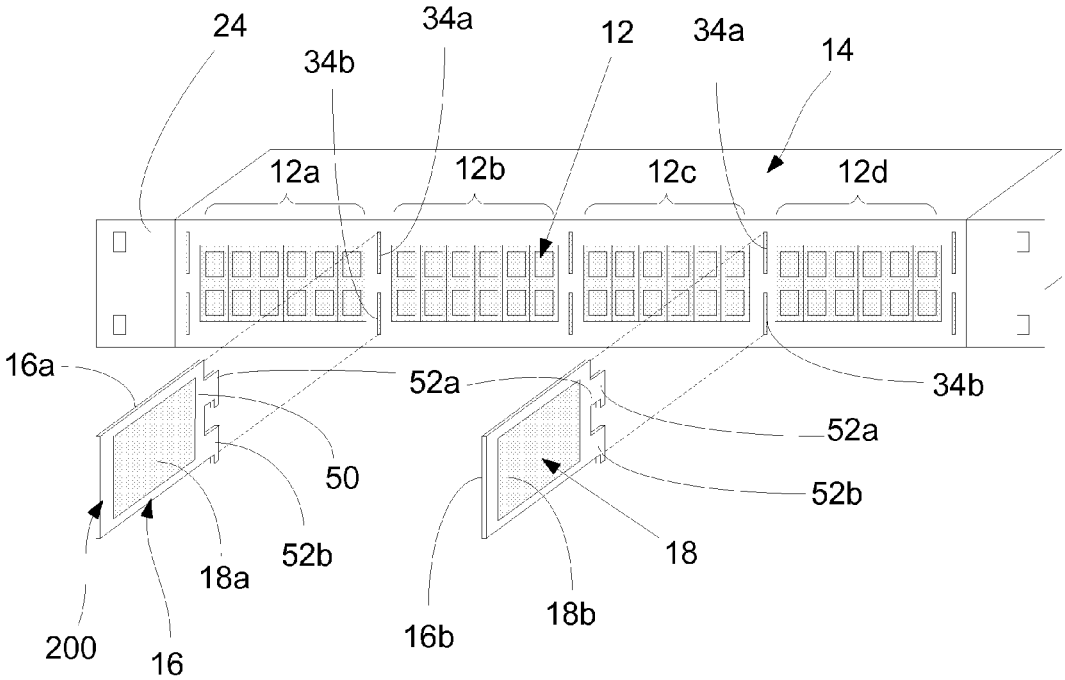
FIG. 7 is a front perspective view of the labeling assembly shown in FIG. 6 detached is the patch cord panel.

The labeling assembly 200 shown in FIGS. 6 and 7 is used to assist in the identification of jacks 12 of a patch cord panel 14. The assembly 200 includes an information plate 16 having a plurality of predetermined areas 18 for bearing indicia for uniquely identifying respective ones of the jacks 12 of the patch panel 14. The assembly also includes a fastener 20 for coupling the information plate 16 to the patch cord panel 14. The assembly 200 operates in an analogous manner to that of the assembly 10 and the assembly 100 and like parts a marked with like numbers.

In the embodiment shown in FIGS. 6 and 7, the patch cord panel 14 includes four groups 12*a*, 12*b*, 12*c*, 12*d* of twelve jacks 12 arranged side by side along a front face 24. The jacks 12 of each group 12*a*, 12*b*, 12*c*, 12*d* are arranged in two rows stacked on top of one another.

Figure 8:
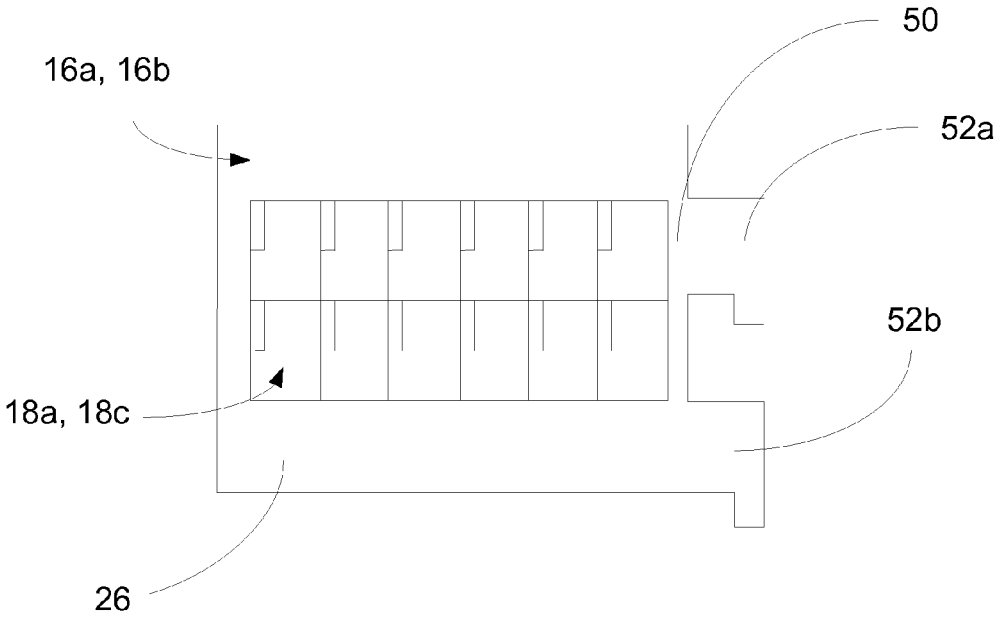
FIG. 8 is a side view of the labeling assembly shown in FIG. 6.
Figure 9:
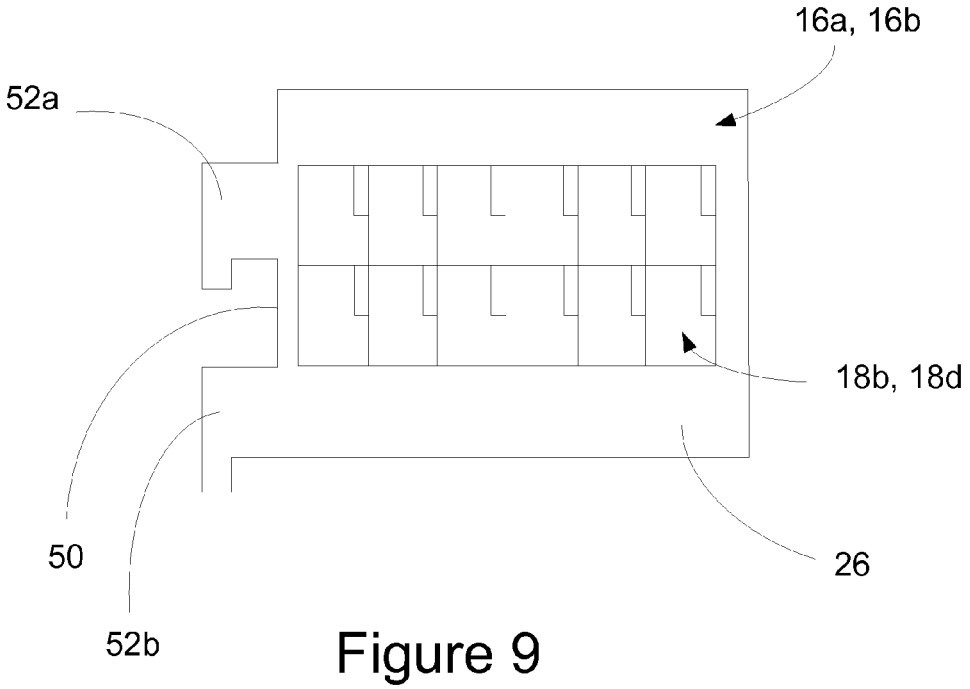
FIG. 9 is a another side view of the labeling assembly shown in FIG. 6.

The information plate 16 is formed in two parts 16*a*, 16*b*. Each plate 16*a*, 16*b* includes a generally planar, rectangular main body section 26. As particularly shown in FIGS. 8 and 9, each plate 16*a*, 16*b* also includes two groups 18*a*, 18*b*, 18*c*, 18*d* of twelve predetermined areas 18 for bearing indicia for labeling the jacks 12 of the patch cord panel 14. The groups 18*a*, 18*b*, 18*c*, 18*d* being arranged on opposite sides of the plates 16*a*, 16*b*.

The predetermined areas 18 of each group 18*a*, 18*b*, 18*c*, 18*d* are arranged in two rows stacked on top of one another. A short side 50 of the rectangular main body section 26 of each plate 16*a*, 16*b* is shaped to abut the front face 24 of the patch cord panel 14 between the groups of jacks 12*a*, 12*b*, 12*c*, 12*d* in such a way that the groups 18*a*, 18*b*, 18*c*, 18*d* of predetermined areas 18 are located adjacent corresponding groups

12*a*, 12*b*, 12*c*, 12*d* of jacks 12. The plates 16*a*, 16*b* separate the groups 12*a*, 12*b*, 12*c*, 12*d* of jacks 12 when so arranged.

The fastener 20 includes a pair of lugs 52*a*, 52*b* that extend from the short side 50 of each plate 16*a*, 16*b*. The lugs 52*a*, 52*b* are generally co-planar with the main body section 26 of the plates 16*a*, 16*b*. The lugs 52*a*, 52*b* are shaped for mating with receptacles 34*a*, 34*b* formed in the front face 24 of the patch cord panel 14. The fastener 20 couples the labeling assembly 200 to the patch cord panel 14 when the lugs 52*a*, 52*b* of the plates 16*a*, 16*b* are seated in corresponding recesses 34*a*, 34*b*. When so arranged, the four groups 18*a*, 18*b*, 18*c*, 18*d* of predetermined areas 18 are located adjacent corresponding groups 12*a*, 12*b*, 12*c*, 12*d* of jacks 12.

The location of each predetermined area 18 of the labeling assembly 200 is arranged to correspond to the location of a corresponding jack 12 of the patch cord panel 14. As such, the labeling assembly 200 functions as a key for uniquely identifying each jack 18 of the patch cord panel 14. The plurality of predetermined areas 18 of the labeling assembly 200 may be an array of cells, each made of a material capable of bearing indicia from a felt tip pen, for example, or any other suitable writing instrument. In this embodiment, the array of predetermined areas 18 may be either fixed to the assembly 200, or, alternatively, detachable for replacement. The plurality of predetermined areas 18 can thereby be used to record information about each jack of the patch cord connector 14.

Besides the above-described plurality of predetermined areas 18 for labeling the jacks 12, the labeling assembly 200 also includes predetermined areas for identifying free jacks, and for labeling functions of patch cords and other identifying information.

The assembly 200 has been described as including two plates 16*a*, 16*b*. However, it will be appreciated by one skilled in the art that more than two plates 16*a*, 16*b* may be suitable for some applications. Furthermore, individual plates 16*a*, 16*b* may be moveably secured to the patch panel 14, or secured to the patch panel 14 in a position away from the front face 24.

The arrangement shown is particularly useful for viewing the information from the side as fewer patch cords need to be moved for viewing than would be the case if there were a single information plate 16 either in the centre or on the side of the front face 24 opposite the viewer.

In each case, the labeling assembly 10, 100, 200 allows fast and easy identification of patch cords and port designations. Furthermore, although the information plates 16 have been above described as being rectangular, other shapes may be used as appropriate, without venturing outside the scope of the claims.

Throughout this specification and claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The claims defining the invention are as follows:

1. A labeling assembly for use in the identification of jacks of a patch cord panel comprising:

(a) an information plate having a plurality of predetermined areas for bearing indicia for uniquely identifying respective ones of the jacks of the patch cord panel; and (b) a fastener for coupling the information plate to the patch cord panel; wherein the fastener includes first and second arms, each being rotatably coupleable to respective sections of the plate and the patch cord panel.

2. The labeling assembly claimed in claim 1, wherein the location of each predetermined area of said predetermined areas corresponds to the location of a corresponding jack of said jacks.

3. The labeling assembly claimed in claim 1, wherein the fastener is adapted to couple the information plate to the patch panel in a position where the predetermined areas are adjacent corresponding jacks.

4. The labeling assembly claimed in claim 1, wherein the information plate includes a generally planar body section having the plurality of predetermined areas for bearing indicia for uniquely identifying respective ones of the jacks of the patch cord panel.

5. The labeling assembly claimed in claim 4, wherein the information plate is generally rectangular and is shaped for location adjacent the jacks of the patch cord panel.

6. The labeling assembly claimed in claim 1, wherein the first and second arms are rotatably coupleable to respective sections of the plate and the patch cord panel by rim and socket joints.

7. The labeling assembly claimed in claim 1, wherein the fastener is adapted to couple the plate to the patch cord panel in a manner that facilitates movement of the plate from a position at the foot of the jacks of the patch cord panel to a position over the jacks of the patch cord panel.

8. The labeling assembly claimed in claim 1, wherein the fastener is adapted to movably couple the plate to the patch cord panel.

9. The labeling assembly claimed in claim 8, wherein the fastener includes a sleeve adapted to effect translation of the plate with respect to the patch cord panel towards or away from the jacks.

* * * * *